US005432310A

United States Patent [19]

Stoeger

[11] Patent Number: 5,432,310

[45] Date of Patent: Jul. 11, 1995

[54] FLUID PRESSURE OPERATED SWITCH WITH PISTON ACTUATOR

[76] Inventor: Helmut Stoeger, Herzogstandstrasse, 16 - 8120 Weilheim, Germany

[21] Appl. No.: 96,463

[22] Filed: Jul. 22, 1993

[30] Foreign Application Priority Data

Jul. 22, 1992 [DE] Germany ..... 9209877 U

[51] Int. Cl.[6] ..... H01H 35/38

[52] U.S. Cl. ..... 200/82 R

[58] Field of Search ..... 200/82 R, 82 E, 81 R, 200/81.4, 81.9 R, 81.9 M, 81.9 HG, 83 R–83 Y

[56] References Cited

U.S. PATENT DOCUMENTS

| | | | |
|---|---|---|---|
| 4,471,182 | 9/1984 | Wielgos et al. | 200/83 P |
| 4,752,658 | 6/1988 | Mack | 200/82 R |
| 5,004,873 | 4/1991 | Schnut | 200/83 P |
| 5,089,673 | 2/1992 | Strzodka | 200/82 C |

*Primary Examiner*—J. R. Scott
*Attorney, Agent, or Firm*—Scully, Scott, Murphy & Presser

[57] ABSTRACT

Pressure switch for moving an electrical contact arrangement including a switch frame supporting fixed contacts and movable contacts, the movable contacts being supported particularly on a contact carrier of the switch frame which is pivoted about a first axis. An intermediate rocking lever is guided on the switch frame and is pivoted about a second axis. A first spring arrangement biases the rocking lever upwardly, and a snap arrangement, containing a torsion coil spring, is interconnected between the rocking lever and the contact carrier. A transmission member, which is moved downwardly by a fluid pressure sensitive piston rod connected thereto, has rollers bearing upon the upper surface of the rocking lever and engages, after a certain downward movement thereof, with a second spring arrangement. When the downward force of the piston rod exceeds the total upward forces of the first spring arrangement, the torsion spring and the second spring arrangement, the rocking lever rotates farther downwardly and, at the limit fluid pressure, the snap arrangement is released to change its force direction thereof which upwardly pivots the contact carrier to open the contact between movable contacts and fixed contacts.

15 Claims, 5 Drawing Sheets

FLUID PRESSURE OPERATED SWITCH WITH PISTON ACTUATOR

BACKGROUND OF THE INVENTION

The present invention relates to a pressure switch for moving a contact arrangement.

In known pressure switches of this kind the first spring arrangement is usually located in the longitudinal apparatus axis, while the second spring arrangement, which exerts its spring force only after play has been overcome, acts on the rocking lever near the free end of the latter. The first and second spring arrangements may also be transposed in position in the pressure switch. In all embodiments of the known pressure switches, the spring, situated in the longitudinal apparatus axis and having the form of a coil compression spring, is supported against a pull rod. In known pressure switches said rod is fastened to the switch frame mounting the contact carrier and the rocking lever. In addition, in known pressure switches the force produced by the drive unit and proportional to the fluid pressure is transmitted via the transmission member exclusively to the rocking lever, which distributes the force between the two spring arrangements. In known pressure switches the rocking lever and also the switch frame thus exposed to considerable forces, which on the one hand require an expensive sturdy construction and on the other hand reduce switching accuracy. These difficulties occur to an even greater extent if the pressure switch is required to master a great switching difference, that is to say if, for example, its contact arrangement goes into the OFF position at a pressure of 100 bar and into the ON position at a pressure of for example 20 bar.

SUMMARY OF THE INVENTION

An object of the present invention is to provide a pressure switch which can be produced inexpensively and works reliably and accurately even with wide switching differences.

With this object and other objects in view, there is provided, according to the present invention, a pressure switch for moving a contact arrangement comprising at least one fixed contact and a movable contact from an ON position into an OFF position when a preset pressure of a fluid to be monitored is reached, and back into the ON position when the pressure falls by a preset pressure difference, and vice versa, comprising:

a switch frame having a longitudinal apparatus axis and on which the fixed contacts are held and on which a contact carrier holding the movable contacts is movably mounted, an intermediate member guided on the switch frame and movable relative to the latter, a snap arrangement coupling the contact carrier to the intermediate member, a drive unit comprising a casing having a chamber which is preferably in the form of a cylinder and is immovably fastened on the switch frame next to a top end thereof, and in which a member preferably in the form of a piston is sealingly guided for sliding in the direction of the longitudinal apparatus axis, the cavity delimited by the chamber and the member being able to be loaded via a bore with the fluid to be monitored, while the member exerts a force which is directed towards the switch frame and is in a predetermined relationship with the fluid pressure and, starting from a top initial position, makes a stroke towards the switch frame with rising pressure, a transmission member coupling the piston member to the intermediate member, a first spring arrangement which counteracts the force of the piston member already in the starting position of the latter with an adjustable prestressing force essentially influencing the ON position and increasing with the stroke of the member, and which contains a first spring supported at one end against a component fixed on the switch frame, a second spring arrangement, which counteracts the force of the piston member only after a predetermined stroke of the piston member, overcoming a clearance, with an adjustable prestressing force essentially influencing the OFF position and increasing with the stroke of the member, and which contains a second spring in the form of a coil compression spring which is supported at one end against a pull rod surrounded by it and fastened to the switch frame, characterised in that the pull rod is fastened exclusively and directly on the drive unit, and in that the transmission member is drivingly connected to the intermediate member and directly drivingly connected, without the interposition of the intermediate member, to the second spring arrangement.

BRIEF DESCRIPTION OF THE DRAWINGS

Further features of the pressure switch according to the present invention will become apparent from the following detailed description of a preferred embodiment thereof, with reference to the drawings, in which.

DESCRIPTION OF THE PREFERRED EMBODIMENTS

Figure 1:
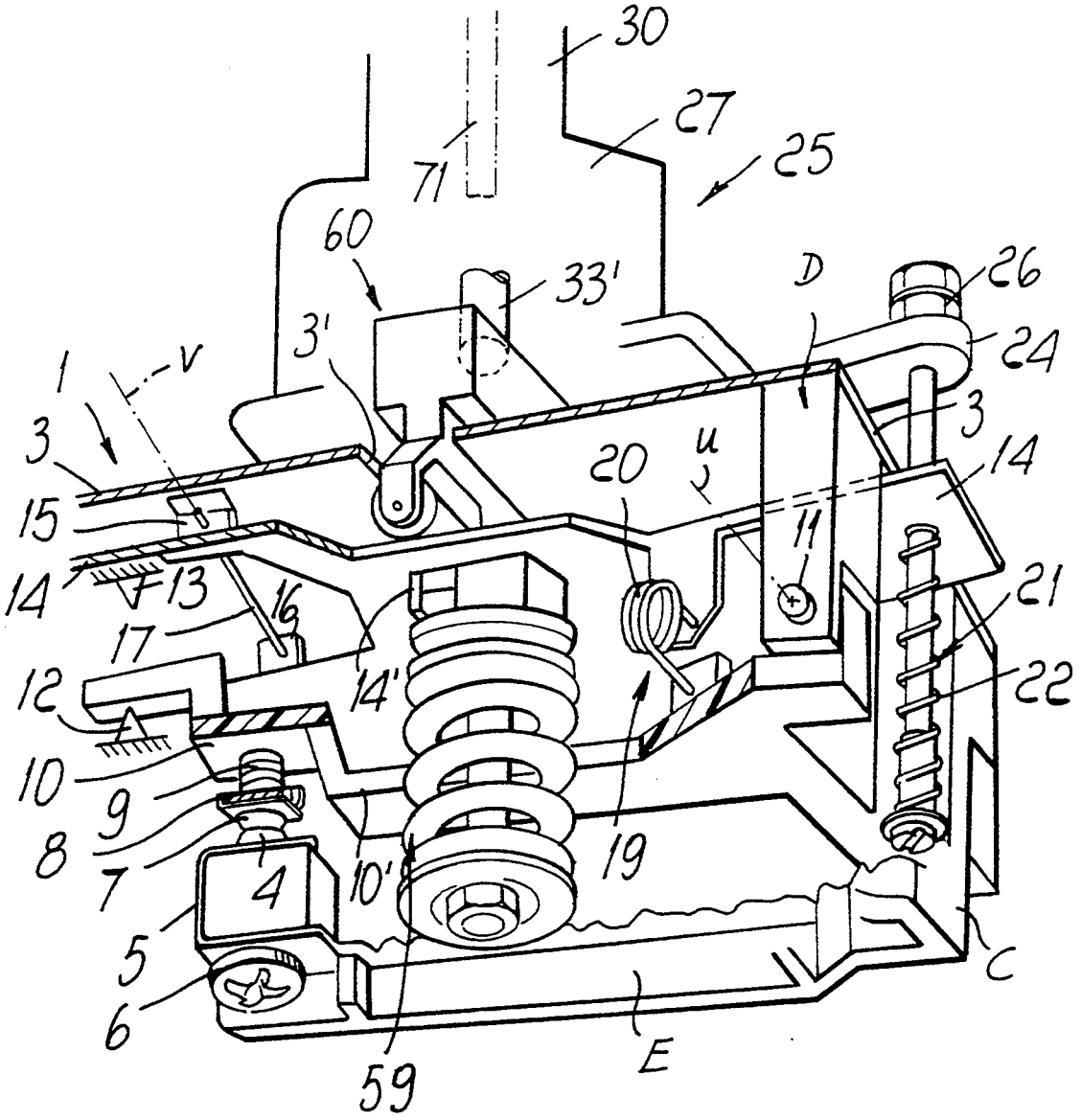
FIG. 1 is a schematic perspective and partially sectional view of the entire pressure switch according to the present invention shown in its on position I.

In the following description, expressions such as "at the bottom" and the like, which relate to the position of components in the drawings of the application, will be used only in order to facilitate understanding. In the utilisation of the pressure switch according to the present invention its components may obviously also assume other positions, depending on the position in which the switch is installed.

Figure 2:
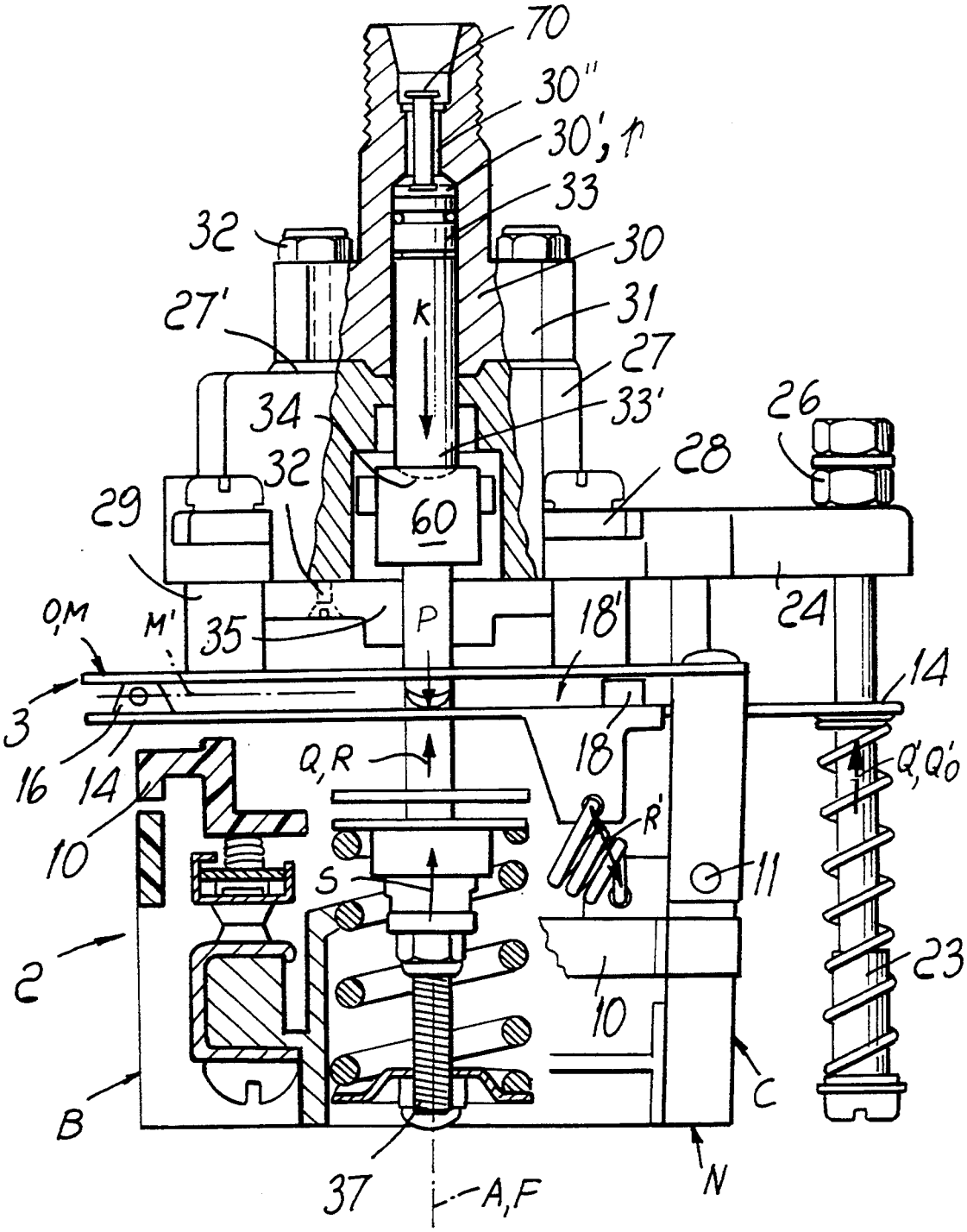
FIG. 2 is a partially sectional side view of said pressure switch.

As shown in FIGS. 1 and 2, the pressure switch, generally designated by the reference numeral 1, is provided with a multipart switch frame, held together by means of screws, and with the longitudinal apparatus axis A, said frame comprising a bottom part 2 formed by a shaped body of insulating material and a top part 3 formed by a shaped sheet metal plate. The top part 3 of the switch frame has a flat configuration with a plane upper face 0 which lies in a first transverse plane M through which the longitudinal apparatus axis A passes at right angles. In the region of the longitudinal apparatus axis A, the top part 3 of the switch frame has a cutout 3'.

The bottom part 2 of the switch frame has, in principle, the shape of a right parallelepiped and is bounded by a first transverse side B and a second transverse side C, both of these sides extending parallel to a first longitudinal centre plane F containing the longitudinal apparatus axis A. It is in addition bounded by a first longitudinal side D and a second longitudinal side E, these longitudinal sides both extending parallel to a second longitudinal centre plane G containing the longitudinal apparatus axis A and lying at right angles to the first longitudinal centre plane F (lying in the plane of the drawing in FIG. 2). The bottom part 2 of the switch frame carries, near its first transverse side B and adjoining the bottom edge of the latter, four fixed contacts 4 arranged side by side in the direction of the edge, each of which is joined to connecting screws 6 with the aid of U-shaped sheet metal bows 5. A movable contact 7 is associated with each fixed contact 4. Each pair of movable contacts lying next to each other is connected together by a conductive contact web 8, which is in turn disposed for sliding, with the interposition of a contact spring 9, on a contact carrier 10 of insulating material. The contact carrier 10 has in principle the shape of a cranked plate which is penetrated by a cutout 10' in the region of the longitudinal apparatus axis A and extends essentially from the first transverse side B to the opposite second transverse side C of the bottom part 2 of the switch frame and which is composed essentially of a part carrying the movable contacts 7 and a part having two pivot pins 11, said two parts being offset in height and disposed substantially parallel to the first transverse plane M.

The contact carrier 10 is mounted on the bottom part 2 of the switch frame by means of the two pivot pins 11 in such a manner that it can make a pivoting movement about a first pivot axis U which extends in a transverse plane M' parallel to the first transverse plane M and in a plane situated near the second transverse side C and parallel to the first longitudinal centre plane F. Stops 12, 13 fixed on the contact carrier 10 cooperate with two stop surfaces fixed on the switch frame 1 and limit the pivoting range of said contact carrier. The first bottom stop 12 thus has the effect that, when the contact carrier 10 moves in the contact closing direction, the contact springs 9 are compressed only to a preset extent, while the second top stop 13 determines the extent to which the movable contacts 7 are moved away from the fixed contacts 4 when there is a movement in the contact opening direction. A contact web 8, the two movable contacts 7 connected thereby, and the two fixed contacts 4 associated therewith, with their sheet metal bows 5 and connecting screws 6, form together a contact arrangement which in an ON position closes a circuit between the two connecting screws 6 and doubly interrupts this circuit in the OFF position.

Between the top part 3 of the switch frame and the contact carrier 10 there is an intermediate member, formed by a rocking lever 14, which is formed from a shaped sheet metal plate and which, in principle, lies in a plane parallel to the first transverse plane M and extends substantially from the first transverse side B to the second transverse side C of the bottom part 2 of the switch frame. In the region of the longitudinal apparatus axis A the rocking lever 14 is penetrated by a cutout 14' and on its upper face has two plane running surfaces 14'' at least on the two portions which extend on both sides of the first longitudinal centre plane F from the cutout 14' to the two longitudinal sides of the rocking lever 14 which adjoin respectively the first and second longitudinal sides D, E of the bottom part 2 of the switch frame.

Two lugs 15 are bent 90 degrees downwards from the top part 3 of the switch frame, near the first transverse side B, each of them being associated with a respective lug 16 bent 90 degrees upwards from the rocking lever 14. A common pivot rod 17 extends through holes in the lugs 15, 16 and has a (second) pivot axis V extending parallel to the first transverse plane M and the first longitudinal centre plane F and situated near the first transverse side B. It should be noted that the pivot axis V of the rocking lever 14 and the pivot axis U of the contact carrier 10 are situated on different sides of the first longitudinal centre plane F. A stop 18, as shown in FIG. 9, which can be brought into engagement with a stop surface 18' formed on the top part 3 of the switch frame, limits the pivoting range of the rocking lever 14 and defines its top end position I.

Near its free end remote from the pivot axis V the rocking lever 14 is coupled to the contact carrier 10 by means of a snap arrangement, generally designated by the reference numeral 19. When the rocking lever 14 is pivoted out of its top end position I in the direction of the bottom end position V, the snap arrangement 19 has the effect, even in the case of a pivoting movement proceeding very slowly, that when a third intermediate position IV, as explained hereinafter is reached the contact carrier 10 is suddenly moved out of its original ON position into the OFF position and remains in the OFF position until the bottom end position V is reached. If the rocking lever 14 is pivoted out of its bottom end position in the direction of the top end position, the contact carrier 10 is suddenly moved back into the ON position when a first intermediate position II, as explained hereinafter is reached. The first intermediate position II thus lies closer than the third intermediate position IV to the top end position.

The snap arrangement 19 preferably contains a torsion coil spring 20 whose two straight arms engage in bores formed on the one hand in downwardly bent lugs on the rocking lever 14 and on the other hand in an upwardly projecting rib on the contact carrier 10. The snap arrangement 19 exerts a force R' on the rocking lever 14. In order to simplify the description of the present invention, a (fictitious) force R derived therefrom by conversion is introduced, which acts in the longitudinal apparatus axis A and on the rocking lever 14 at a (fictitious) force application point situated in the aforesaid second transverse plane M'. The magnitude of this force R is dependent on the position of the rocking lever 14 relative to the bottom part of the switch frame and on the relative position of the rocking lever and of the contact carrier 10, as well as on the movement direction of the rocking lever. This force R is equal to zero directly before the snap actions occur (positions II and IV) and it changes its direction after the snap actions.

A first spring arrangement 21, the prestressing force Q'o whereof, which is adjustable and equals the initial force exerted in the most unstressed state, also acts on the rocking lever 14 with a force Q' which is always directed upwards. This spring arrangement comprises a first coil compression spring 22, the top end whereof lies against the underside of the rocking lever 14 near the free end of the latter. An adjusting screw 23, against whose head the other bottom end of the coil compression spring 22 lies, extends through the latter and also through a bore in a laterally projecting arm 24 of a drive unit 25 (further explained later on) held immovably on the switch frame 1. A first nut 26 is screwed onto the threaded end of the screw 23 projecting upwards through the bore, and is secured by means of a locknut. Through the relative turning of the screw 23 and nut 26 the initial value of the force Q', namely the prestressing force Q'o, by which the first spring arrangement 21 acts on the rocking lever 14 initially, that is to say in the top end position I of the latter, can be adjusted. If the rocking lever 14 is moved downwards away from the stop surface 18', the force Q', starting from the value Q'o, increases approximately by a value proportional to the length of the movement stroke. In order to facilitate the description of the present invention, forces Q and Qo derived respectively by conversion from the forces Q' and Q'o are introduced, which act in the longitudinal apparatus axis A and on the rocking lever 14 at a fictitious force application point situated in the longitudinal apparatus axis A.

The drive unit 25 has in particular the purpose of providing a force K in dependence on a physical magnitude which is to be monitored. In the present embodiment, relating to a pressure switch, the pressure of a fluid is converted into a force K proportional thereto and acting downwards in the longitudinal apparatus axis A.

The drive unit 25 comprises a substantially pot-shaped casing 27 open in the direction of the top part 3 of the switch frame and provided with a fastening flange 28 which projects radially outwards and on which the arm 24 is formed. The casing 27, the fastening flange 28 and the arm 24 are preferably formed by a one-piece aluminium casting. The fastening flange 28 is fastened by a plurality of screws on the top part 3 of the switch frame, with the interposition of spacer sleeves 29, in such a manner that its longitudinal axis lies in the longitudinal apparatus axis A. The drive unit 25 further comprises a cylinder 30 which is open in the downward direction, that is to say towards the casing 27, and is provided with a holding rim 31 which projects radially outwards and lies against the bottom part 27' of the casing 27 and which is held on the latter by means of screw connections 32 (explained later on) in such a manner that the cylinder axis lies in the longitudinal apparatus axis A. A piston 33 sealed by 0-rings is slidable in the cylinder 30 and, in conjunction with the cylinder, delimits a cavity 30' which can be loaded, by way of a threaded bore 30'' situated in the longitudinal apparatus axis A, with the fluid to be monitored, its piston rod 33', having a diameter the same as that of said piston, extending through an opening in the bottom part 27' into the interior of the casing 27. The free, downwardly pointing end of the piston rod 33' has a convex spherical cap 34.

Figure 3:
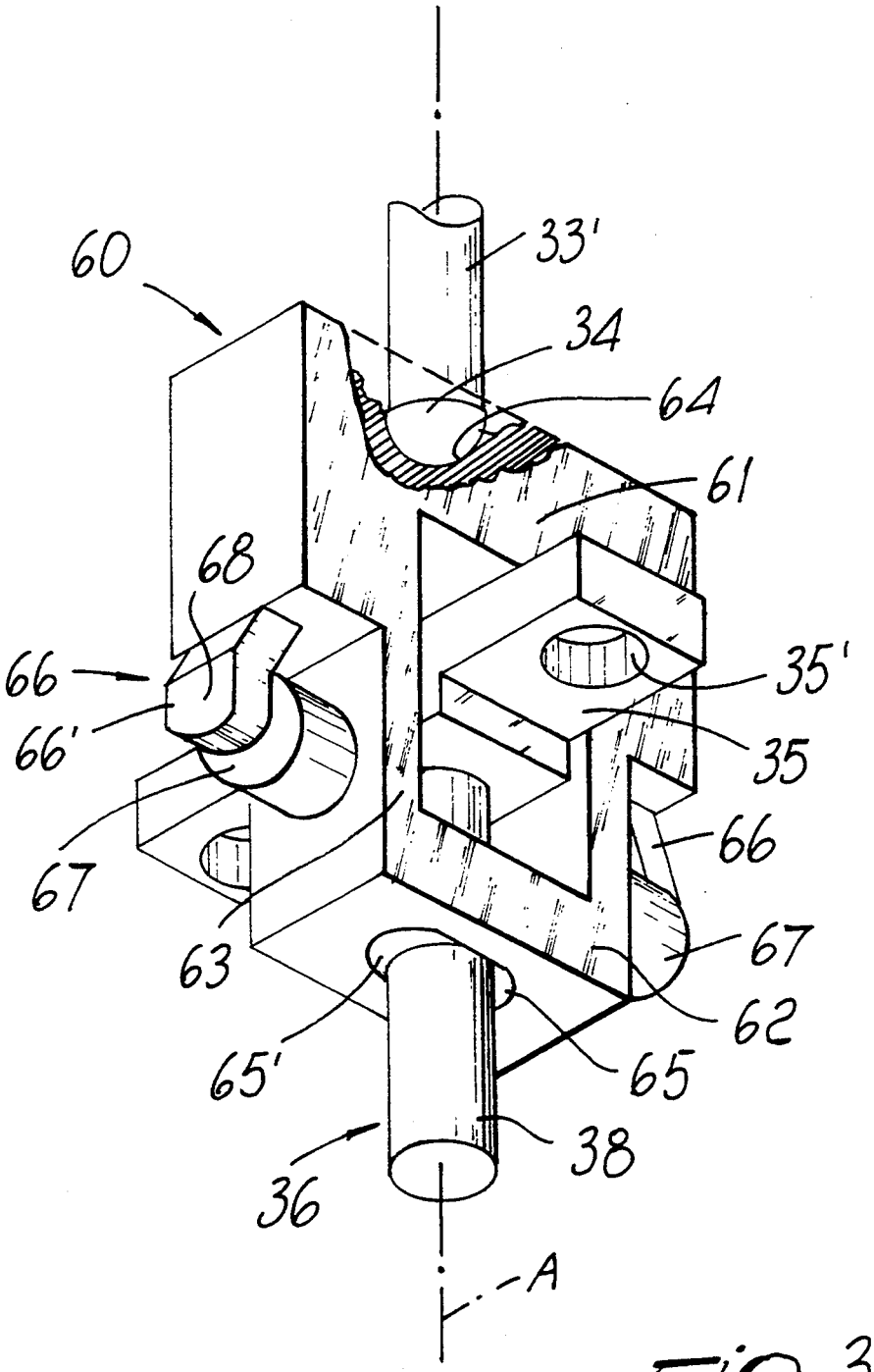
FIG. 3 is a perspective view of a detail of the pressure switch, on a larger scale.

The bottom opening of the casing 27 is bridged over by a web 35 (see FIGS. 2 and 3), on which a pull rod 36, which at its free end has an externally threaded part 37, is rigidly fastened. The pull rod 36, whose axis lies in the longitudinal apparatus axis A, extends through the cutouts 3', 14' and 10' in the top part 3 of the switch frame, the rocking lever 14 and in the contact carrier 10 respectively and ends close in front of the underside N of the bottom part 2 of the switch frame. The web 35 is fastened, next to its two lateral ends, to the drive unit 25, that is to say without the insertion of other components of the pressure switch. The particular advantage of this construction resides in the fact that the powerful forces which have to be transmitted by the pull rod 36, and includes a force S of a second spring arrangement 59 as will be explained in further detail below, are transmitted in the longitudinal apparatus axis A without exerting any detrimental, deforming action on the switch frame 1. The latter can therefore be produced at low manufacturing costs, and the pressure switch works more accurately. It is particularly advantageous to use as fastening means two rivets or screw connections 32 which lie diametrically opposite one another in relation to the longitudinal apparatus axis A and which also fasten the holding rim 31 of the cylinder 30. In this arrangement the major part of the reaction force produced as a consequence of the exertion of the force K by the piston 33 is thus transmitted by the screw connections 25, acting as tie rods, directly from the web 35 to the cylinder 30.

Between the externally threaded part 37 and the web 35, and adjoining the latter, the pull rod 36 comprises a first cylindrical length portion 38, the diameter whereof corresponds approximately to or is slightly greater than the outside diameter of the thread of the externally threaded part 37. Adjoining said cylindrical portion a second cylindrical length portion extends to the externally threaded part 37 and has a smaller diameter corresponding approximately to the thread core diameter of the externally threaded part.

A securing sleeve 40 is pushed onto the pull rod 36; its function and installation will be explained more fully further on and it will be described hereinafter for the operative (that is to say adjusted) state of the pressure switch. The securing sleeve 40 lies against the underside of the web 35 and extends almost to the externally threaded part 37. The securing sleeve 40, which has a substantially constant wall thickness over its entire length, comprises, apart from two short length portions 40' and 40'', a top length portion 40''', whose inner diameter is slightly larger than the diameter of the first length portion 38 of the rod 36 and which is supported at the top end against the web 35.

The pull rod 36 is surrounded by an adjusting member 41 of substantially tubular shape. Adjoining its bottom end an internal screw thread 42 is formed in its bore and is screwed onto the externally threaded part 37, locking expediently being effected by means of a locknut 43. A first cylindrical bore portion 44 adjoins the internal screw thread, its diameter being greater, to the extent of twice the wall thickness of the securing sleeve 40, than the diameter of the second cylindrical length portion 39 of the pull rod 36. The first bore portion 44 widens via a short conical bore portion 45 into a second cylindrical bore portion 46, whose diameter is equal to or slightly greater than the outside diameter of the securing sleeve 40.

On its external periphery the adjusting member 41, once again starting from its bottom end, has an external screw thread 47 and, adjoining the latter (and optionally separated by an undercut) a cylindrical peripheral surface 48 and a collar 49 projecting radially outwards therefrom. The inside thread diameter of the external screw thread is equal to or greater than the width across corners of the locknut 43. The external screw thread 47 is provided to receive an auxiliary nut 50, which is used for installation and adjustment purposes and which will be explained later on, but is no longer present in the pressure switch when the latter is ready for use. The cylindrical peripheral surface 48, which takes up approximately half the axial length of the adjusting member 41, has a diameter which is equal to or slightly greater than the outside thread diameter of the external screw thread 47. A first spring plate 51 is mounted on the peripheral surface 48 for sliding in the axial direction. Said spring plate contains a tubular part 52 whose cylindrical bore has an inside diameter which larger, by a slight clearance, than the outside diameter of the collar 49 on the adjusting member 41 and which, by means of this bore, is slidingly guided on said collar. Adjoining its bottom end the tubular part 52 is narrowed by an internal collar 53 whose cylindrical bore is larger, by a slight radial clearance, than the first cylindrical length portion 38 of the pull rod 36 and which is slidingly guided on said length portion.

The relative movement of the first spring plate 51 in relation to the adjusting member 41 is limited by the striking against one another of the respective annular axial end faces of the inner collar 53 and the outer collar 49. The clearance occurring in certain operating states, i.e., the distance in the direction of the longitudinal apparatus axis A between these two end faces will be designated by "X" in the further description of the operation mode. Adjoining its top end, the tubular part 52 is provided with a flange 54 projecting radially outwards. The transition edge 55 between the top end face of this flange 54 or tubular part 52 and the bore of said tubular part is rounded. In the state of readiness for use, the bottom length portion 40', the conical length portion 40'' and an adjoining short part of the top length portion 40''' of the securing sleeve 40 are inserted into the annular gap between the bore portions 44, 45 and 46, on the one hand, and the second length portion 39 of the pull rod 36, on the other hand, while the bottom length portion 40' fills the annular gap in radial direction without clearance and with a prestress.

A second coil compression spring 56 surrounding the pull rod 36 and the adjusting member 41 extends from the first spring plate 51 to a second spring plate 57, which is situated near the bottom free end of the pull rod and which is supported against a spring tightening nut 58 screwed onto the externally threaded part 37 of the pull rod 36. The second coil compression spring 56 forms, in conjunction with the first and second spring plates 51, 57, the spring tightening nut 38, the pull rod 36, the securing sleeve 40, and the adjusting member 41, a second spring arrangement 59, whose force S acts in the upward direction in the longitudinal apparatus axis A and whose initial prestressing force So is adjustable by means of the spring tightening nut 58 which enable adjustment the OFF position of the contact arrangement or of the switching difference.

The connection between the piston rod 33' of the drive unit 25 and the rocking lever 14 and also the second spring arrangement 59 is made by a transmission member (see in particular FIG. 3), generally designated by the reference numeral 60 and disposed with its longitudinal axis in the longitudinal apparatus axis A. The transmission member 60 has a symmetrical configuration both in respect of the first longitudinal centre plane F and in respect of the second longitudinal centre plane G. The transmission member 60 contains a substantially rectangular frame, which extends in the first longitudinal centre plane F and surrounds the web 35 with lateral clearance and with a larger movement clearance in the direction of the longitudinal apparatus axis A. The frame comprises a top crosshead 61, a bottom crosshead 62 and two struts 63 connecting the latter and extending parallel to the longitudinal apparatus axis A. The top crosshead 61 has on its upper face a spherical depression 64 situated in the longitudinal apparatus axis A and receiving the cap 34 of the piston rod 33'.

In the bottom transverse bow 62 a slot 65 is formed, through which the first length portion 38 of the pull rod 36 extends. The slot 65 has its greatest width in the first longitudinal centre plane F. It has two plane wall surfaces 65', which are arranged on both sides of the longitudinal centre plane F and extend equidistantly from and parallel to the latter and which surround the pull rod with slight radial clearance, so that the transmission member 60 can make, relative to the pull rod 36, a pivoting movement in the first longitudinal centre plane F. At the other end the transmission member 60 receives, in the first longitudinal centre plane F in each case, guidance by the engagement of the cap 34 of the piston rod 33' in the depression 64 and also by the supporting of the rollers 67 on the running surfaces 14'' of the rocking lever 14. In the second longitudinal centre plane G, the transmission member 60 is guided once again by the cap 34 and the depression 64 and in addition by a slideway on parallel wall surfaces of the casing 27, said slideway also attending to the prevention of twisting. Through this configuration the jamming of these components, which could impair the accuracy of the pressure switch, is advantageously counteracted. In a simplified embodiment the piston rod 33' can also be rigidly joined to the transmission member 60.

On the frame of the transmission member 60 two arms 66 are formed, provided with downwardly pointing arm parts 66' which in each case extend laterally outside the struts 63 at a distance from the latter. Between each strut 63 and the appertaining arm part 66' a roller 67 is disposed and is rotatably mounted by a vertical axis 68 situated in the first longitudinal centre plane F and at right angles to the longitudinal apparatus axis A. The two rollers 67 lie against the two running surfaces 14'' on the upper face of the rocking lever 14.

The underside of the transmission member 60 is plane and is situated in a transverse plane through which the longitudinal apparatus axis A passes at right angles. A frustum-shaped disc 69 bears by its plane top face against the underside and surrounds by its bore the top length portion 40''' of the securing sleeve 40, leaving a substantial radial clearance. The conical surface 69' of the disc 69 can come to bear against the rounded transition edge 55 of the first spring plate 51 when an initial clearance Y, measured in the direction of the longitudinal apparatus axis A, is overcome by a downward movement of the transmission member 60. If desired, this clearance may also be provided between the disc 69 and the transmission member. Through the configuration explained, the transmission member 60 can be adjusted both by a transverse movement and by an all-round change of angular position on the first spring plate 51, which in turn, apart from its axial slidability, is guided on the pull rod 36 and thus also has fixed guidance on the casing. Internal stresses impairing the accuracy of the pressure switch are thus avoided.

The force K exerted by the drive unit 25 via the transmission member 60 is branched initially, that is to say as long as a clearance Y still exists, only into two equal forces which act exclusively downwards and which act on the rocking lever 14 by way of the two rollers. If the clearance Y becomes equal to zero, the force K is also branched into a force which acts exclusively down-wards and in the longitudinal apparatus axis and which acts oppositely to the force S of the second spring arrangement 59. To facilitate the description of the present invention it will be assumed that, instead of the two forces P', their total force P acts on the rocking lever 14 in the longitudinal apparatus axis A. For the purposes of further examination and for the sake of simplicity it will also be assumed that the effective lever length for the forces P, Q and R is invariable despite the movement of the rocking lever 14.

Figure 4:
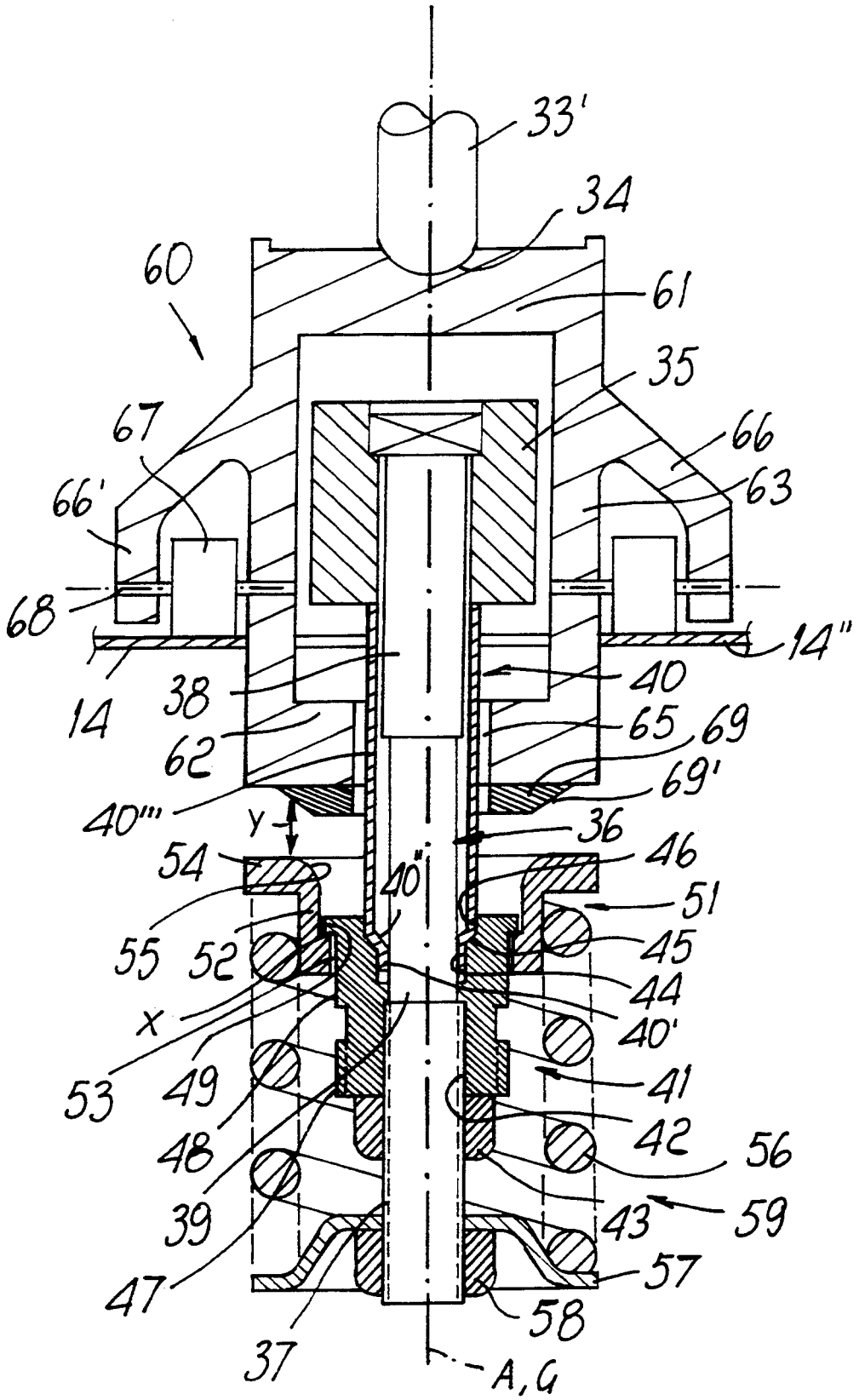
FIG. 4 is an axial sectional view through a detail.

In order to explain the operation mode, the starting point taken will be a pressure switch adjusted ready for operation and the initial state illustrated in FIGS. 1, 2 and 4, that is to say the contact arrangement 4–10 is in the ON position, the pressure p of the fluid and thus also the force K of the piston 33 are zero, the piston 33 with its piston rod 33' and also the transmission member 60 are in their top end positions (position I and location I respectively), the rollers 67 lie without force on the running surfaces 14'' of the top face of the rocking lever, the rocking lever 14 is pressed by the first spring arrangement 21 and the torsion spring 20 of the snap arrangement 19 with its stop 18 against the stop surface 18' of the upper part 3 of the switch frame (location I), and the clearance Y between the transmission member 60 disc 69 of and the second spring arrangement 59 first spring plate 51 is at its maximum value.

If the pressure p rises and the force K rises proportionally thereto, the transmission member 60 and the rocking lever 14 initially remain in their positions explained above until the force K begins to overcome the forces counteracting it, namely the adjusted prestressing force Qo of the first spring arrangement 21 and the force R of the torsion spring 20. The transmission member 60 then moves downwards, reducing the clearance Y, and the rocking lever 14 moves downwards, i.e. therefor is swivelled in the clockwise direction from the position shown in FIGS. 1 and 2, while the force Q increases and the force R decreases. The rocking lever 14 thus passes through its first intermediate position, which will be discussed later on (location II; transmission member: position II), without thereby giving rise to any action, unlike what occurs when it moves upwards.

Figure 5:
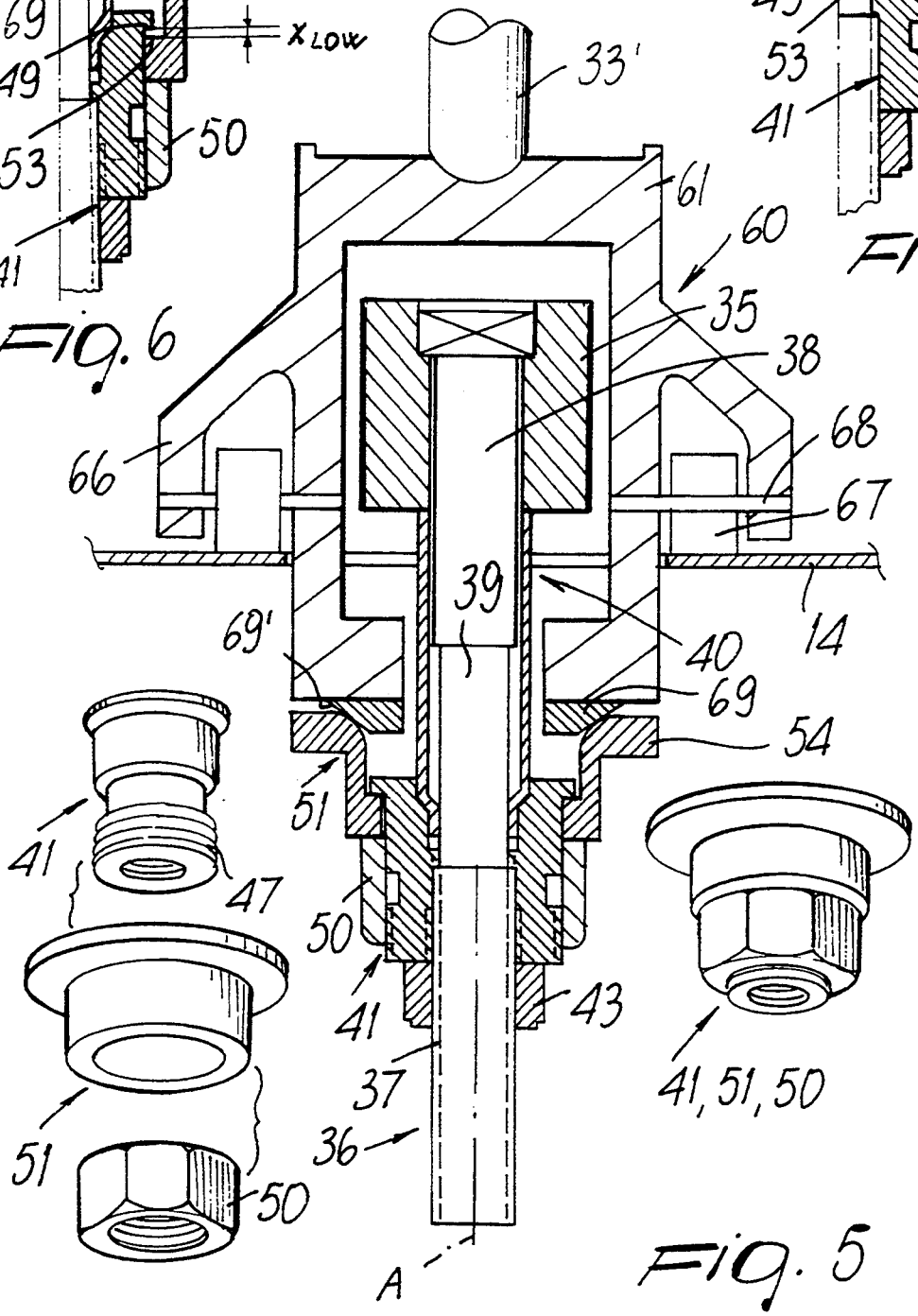
FIG. 5 is an axial sectional view according to FIG. 4 showing the adjustment operation during manufacture of the pressure switch the elements whereof being in an intermediate position II.

When the pressure p and the force K rise further, the transmission member 60 reaches its second intermediate position (position II; rocking lever: location II), in which the clearance Y becomes equal to zero, as shown in FIG. 5, and the transmission member 60 lies against the second spring arrangement 59, while the disc 69 comes into contact with the first spring plate 51. Additionally to the forces Q and R opposing the force K, the powerful prestressing force So of the second spring arrangement 59 now comes into action, so that even a further rise of the pressure p and of the force K does not change the positions of the other components of the pressure switch for the time being.

Figure 6:
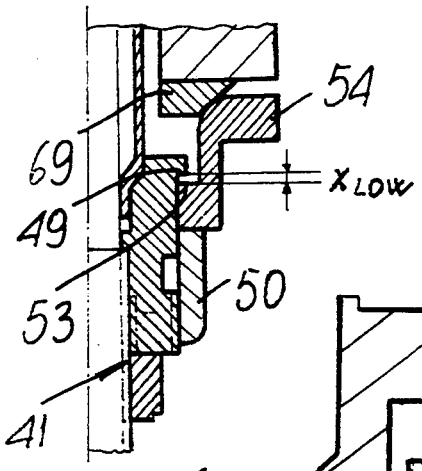
FIG. 6 is a cross-section view of a detail of FIG 5 showing the situation of intermediate position IV.

Only when the force K exceeds the total of the forces Q, R and So, the transmission member 60 and the rocking lever 14 start to move further downwards. The first spring plate 51 moves at the same time in relation to the stationary adjusting member 41, in the downward direction, while the previously mentioned axial clearance X is produced and the force S of the second spring arrangement 59 increases and the force R (slight in relation thereto) of the snap arrangement 19 (torsion spring 20) tends towards zero. After only a low value of X as shown in FIG. 6, the transmission member 60 already reaches a third intermediate position (position IV) and correspondingly the rocking lever 14 reaches its third intermediate position (location IV), in which the snap arrangement 19 is released by the rocking lever and, by means of its torsion spring 20, moves the contact carrier 10 upwards, i.e., pivots it in the clockwise direction from the position shown in FIGS. 1 and 2, while the contact arrangement 4–10 is moved into its OFF position.

Figure 7:
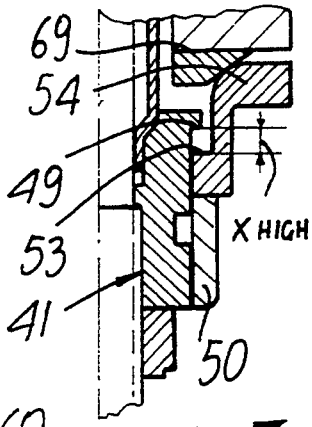
FIG. 7 is a cross-section view of a detail of FIG 6 showing the further situation of the OFF position V.

The apparatus supplying the fluid pressure, for example a compressor, is usually switched off by the contact arrangement which is in the OFF position, so that the pressure p does not rise further or rises only slightly further. In other fields of application of the pressure switch, or in the case of a compressor having a great flywheel effect and/or provided with only a small accumulator, however, the pressure p may rise still further, with the consequence that the transmission member 60 and the rocking lever 14 move still further downwards, and increase the clearance X as shown in FIG. 7, until they assume a bottom limit position (position V) or a bottom limit location (location V) respectively. The OFF position of the contact arrangement is retained in this case.

If the pressure p falls, the transmission member 60 and the rocking lever 14 move upwards, while the clearance X first becomes equal to zero and then the clearance Y, starting from zero, rises and the rocking lever passes through its third and second intermediate positions (locations IV and III) without giving rise to any action.

When the rocking lever 14 reaches its first intermediate position (location II) as the pressure p falls further, the snap arrangement 19 is released and moves the contact carrier 10 downwards and thus brings the contact arrangement 4–10 into its ON position. When finally the pressure p falls to zero, the transmission member reaches its top end position (position I) and the rocking lever 14 reaches its top end position (location I) and the 0N position is retained.

In addition to the measures already mentioned, which largely free the switch frame from deforming, eccentrically acting forces, it is very important for the rational manufacture of accurately working pressure switches that, even taking into account the shortage of space inside the pressure switch, an initial adjustment should be possible at the factory in a simple manner and that this adjustment should also be maintained for a long time when the pressure switch is subjected to vibrations caused by its own switching operations and also other vibrations at the installation site. The aim is an adjustment such that the rocking lever 14 operates the snap arrangement 19 to bring the contact arrangement 4 to 8 from the ON position to the OFF position when, as the pressure p increases, the transmission member 60 has come into contact with the second spring arrangement 59 (clearance Y=zero) and thereupon only a minimum compression of the second spring arrangement 59 has come into action (clearance X slight). For this purpose, according to the present invention, the previously mentioned auxiliary nut 50 is used in conjunction with the external screw thread 47 and the adjusting member 41, the otherwise special configuration of the latter, the securing sleeve 40 and an adjusting device 71, the adjustment process explained below being utilised.

The starting point is a completely assembled pressure switch (FIG. 5), in which only the second coil compression spring 56, the second spring plate 57 and the spring tightening nut 58 have not yet been installed. The auxiliary nut 50 is screwed onto the external screw thread 47 and fixes the first spring plate 51 in its uppermost position (clearance X=zero) in relation to the adjusting member 41. The unit thus formed, including the locknut 43, is arranged far down on the externally threaded part 37 (clearance Y greater than any value assumed in operation, including possible manufacturing tolerances), or the components 41, 43 and 51 have not yet been installed. Unlike what is shown in FIG. 5, the securing sleeve 40 still has an outside diameter which is the same over its entire length, corresponding to the top length portion 40''' (shown in FIG. 4). The pressure switch is not loaded with pressure fluid (p=zero). Through the action of the first spring arrangement 21 and of the torsion spring 20 of the snap arrangement 19 the piston 33, the transmission member 60 and the rocking lever 14 are held in their top end positions. The contact arrangement 4 to 8 is in the ON position.

The purpose of the adjusting device 71 is to adjust the transmission member 60 and the rocking lever 14 vertically in relation to the switch frame 1 and make this vertical position readable as a measurement, while the force application point and the force direction should as far as possible lie in the longitudinal apparatus axis A, so that the pressure switch is adjusted in accordance with its subsequent working conditions and the unavoidable deformations through the action of forces under such conditions. The adjusting device 71, as indicated schematically in FIG. 1, preferably has a nipple provided with external and internal screw threads and screwed into the threaded bore 30'' of the cylinder 30; the nipple receives an adjusting spindle, the bottom end whereof can be brought to lie against the piston 33. The nipple and the adjusting spindle are provided with a scale and pointer arrangement which enables the depth position of the bottom end of the adjusting spindle, and therefore also the position of the rocking lever 14, to be ascertained.

Starting under the above initial conditions, the adjustment process is carried out as follows:

The piston 33, the transmission member 60 and the rocking lever 14 are moved downwards by means of the adjusting device (by turning the adjusting spindle the internally threaded bore of the nipple) until the contact arrangement jumps over from the ON position to the OFF position. This position is read on the scale and recorded as first value.

The components 33, 60 and 14 are moved back in the upward direction by means of the adjusting device 71 (screwing the spindle outwards) until the contact arrangement jumps over from the OFF position into the 0N position. This position is recorded as second value.

The components 30, 60 and 14 are moved downwards by means of the adjusting device 71 (screwing the spindle inwards) as far as a third value lying between the first and second values, preferably close to the first value. The components 30, 60 and 14 are held in such a position by the adjusting device, even during the subsequent steps.

The adjusting member 41, together with the first spring plate 51 held by the auxiliary nut 50, is screwed upwards on the externally threaded part 37 of the pull rod 36, while the bottom end of the securing sleeve 40 at first penetrates into the second bore portion 46 (of larger diameter) of the adjusting member 41 (see FIG. 4), is then deformed radially inwards by the conical bore portion 45, and is thereupon pressed into the first bore portion 44 having a smaller diameter. On completion of this step the bottom length portion 40', which directly adjoins the bottom end of the securing sleeve 40, therefore completely fills the annular gap formed by the first bore portion 44 of the adjusting member 41 and by the second length portion 39 of the pull rod 36, producing radial prestressing. A frictional connection resisting vibration is thereby formed between the adjusting member and the pull rod.

The adjusting member 41 is then screwed further upwards until the transition edge 55 of the first spring plate 51 comes to lie against the conical surface 69' of the disc 69, that is to say until the clearance Y becomes equal to zero.

The auxiliary nut 50 is then detached and the locknut 43 fitted. During this operation it is not necessary—and would also be difficult because of the restricted space—to secure the adjusting member 41 against turning, since it is already secured by the previously mentioned frictional connection.

Finally, the second coil compression spring 56 and the second spring plate 57 are installed and said spring is prestressed with the aid of the spring tightening nut 58. In addition, the adjusting device 71 is removed.

Modified embodiments of the pressure switch according to the present invention may comprise variations from the embodiment described above, which are familiar to those skilled in the art, in respect of the arrangement and configuration of the components. Thus, in particular, components which have been described as rotatable may be replaced by slidably guided components.

I claim:

1. Pressure switch for moving a contact arrangement comprising at least one fixed contact and a contact movable from an ON position to an OFF position when a preset pressure of a fluid to be monitored is reached, and back into the ON position when the pressure falls by a preset pressure difference, comprising:

a switch frame having a longitudinal apparatus axis, said fixed contacts being supported on said frame;

a contact carrier for holding said movable contacts, said contact carrier being movably mounted on said frame;

an intermediate member guided on said frame and movable between a top end position corresponding to said ON position of said movable contact and a further bottom end position corresponding to said OFF position of said movable contact;

a snap arrangement coupling said contact carrier to said intermediate member with a spring means, said spring means comprising two arms, a first one of said arms being connected to said contact carrier and a second one being connected to said intermediate member, said snap arrangement being adapted to snap said contact carrier and said movable contact in its OFF position and respectively in its ON position;

a drive unit for providing a force in dependence of the pressure of the fluid to be monitored, said driving unit being immovably fastened on said frame next to a top end thereof and said driving unit comprising a chamber and a piston member, said piston member being sealingly guided for sliding in said chamber along a direction corresponding to said apparatus longitudinal axis, and said chamber having a loading bore, said piston member delimiting in conjunction with said chamber a cavity, and said cavity being loadable via said bore with the fluid to be monitored, whereby said piston member being movable from a top initial position towards said frame for exerting with a free end thereof a force directed towards said frame, said force being a predetermined relationship with said fluid pressure, to a bottom end position;

a transmission member drivingly mounted between said free end of said piston member and said intermediate member for transmitting the force exerted by said piston member to said intermediate member;

a first spring arrangement exerting an elastic force for counteracting the force exerted by said piston member, said first spring arrangement comprising a first compression spring, said first spring having a first end thereof lying against said intermediate member and a second end being connected to said drive unit;

a second spring arrangement exerting an elastic force to further counteract the force exerted by said piston member, said second spring arrangement comprising a second compression spring which surrounds a pull rod, said pull rod being fastened exclusively to said drive unit, wherein said second spring has a first end supported at a free end of said pull rod and a second end, said second end being directly drivingly engageable by said transmission element; and wherein said second end is spaced away from said transmission member in said ON position by an initial clearance extending in the direction of the longitudinal apparatus axis, said piston member being movable under effect of increasing pressure exerted by said fluid to be monitored in said cavity from said top initial position, against a force exerted by said snap arrangement spring means and an adjustable prestressing force of said first spring, by a stroke overcoming said clearance, and furtheron, against the elastic force exerted by said second spring, to said bottom end position corresponding to said OFF position.

2. Pressure switch according to claim 1, wherein the intermediate member is formed by a rocking lever extending at least approximately parallel to a first transverse plane, through which the longitudinal apparatus axis passes at right angles, and mounted on the switch frame for pivoting about a pivot axis situated in said transverse plane and laterally offset from the longitudinal apparatus axis, and wherein the first spring is supported at its other end on the rocking lever.

3. Pressure switch according to claim 1, wherein the longitudinal axes of the piston member, of the transmission member and of the pull rod lie in the longitudinal apparatus axis.

4. Pressure switch according to claim 1, wherein the pull rod is fastened substantially centrally on a web which is in turn fastened at both ends to a casing of the drive unit.

5. Pressure switch according to claim 4, wherein the web is fastened by means of screw or rivet connections which act on a holding edge of the cylinder receiving the piston.

6. Pressure switch according to claim 4, wherein the transmission member contains a frame which surrounds the web and whose bottom crosshead remote from the drive unit has a bore which is formed coaxially to the longitudinal apparatus axis and through which the pull rod extends.

7. Pressure switch according to claim 6, wherein on the transmission member or on the frame two rollers are mounted whose axes lie on the one hand in a plane parallel to the first transverse plane and on the other hand in a first longitudinal centre plane extending parallel to the pivot axis of the rocking lever.

8. Pressure switch according to claim 6, wherein the frame extends in the first longitudinal center plane.

9. Pressure switch according to claim 6, wherein the bore is in the form of a slot whose greatest width is in the direction of the crosshead and which has two wall surfaces which extend on both sides of the first longitudinal centre plane and equidistantly from the latter and which guide the pull rod, leaving a slight movement clearance, in the first longitudinal centre plane.

10. Pressure switch according to claim 1, wherein the other end of the spring contained in the first spring arrangement is supported against a component of the casing of the drive unit.

11. Pressure switch according to claim 1, wherein the coil compression spring of the second spring arrangement is clamped between a first spring plate and a second spring plate, the first spring plate being guided on an adjusting member for sliding in the direction of the axis of the latter, while a collar fixed on the adjusting member limits the relative movement of the second spring plate in the direction of the drive unit and the adjusting member and a spring tightening nut holding the second spring plate are screwed onto an externally threaded part formed at the end of the pull rod.

12. Pressure switch according to claim 6, wherein, starting from the web, the pull rod comprises a first cylindrical length portion and an adjoining second cylindrical length portion extending to the externally threaded part and having a smaller diameter, and wherein the pull rod is surrounded by a securing sleeve which is supported at one end against the web and at its other end penetrates into a narrowing bore in the adjusting member.

13. Pressure switch according to claim 12, wherein the adjusting member has at a bottom axial end thereof an internal screw thread by which it is screwed onto the externally threaded part of the pull rod, and at its other end has, adjoining the internal screw thread, a first cylindrical bore portion which widens via a conical bore portion into a second cylindrical bore portion, all the bore portions surrounding the second length portion of the pull rod, the first bore portion maintaining a radial distance, corresponding substantially to the thickness of the securing sleeve, from the pull rod, and the diameter of the second bore portion corresponding substantially to the outside diameter of the securing sleeve, while the securing sleeve, which originally has a constant outside diameter over its entire length, undergoes, during assembly and during a subsequent adjustment process for eliminating manufacturing tolerances, a diameter reduction through the conical bore portion and with its outer bottom length portion fills, without clearance and with radial prestressing, the annular gap between the first bore portion and the pull rod.

14. Pressure switch according to claim 1, wherein the piston or its piston rod has a convex cap which engages in a spherical depression of complementary shape in the transmission member.

15. Pressure switch according to claim 1, wherein the bore for supplying fluid to the cavity of the drive unit contains a throttle member which reduces its through passage and which consists essentially of a rivet-like body whose stem penetrates into the bore, forms an annular gap together with the latter, is slidable in the axial direction of the bore between stops, and can be driven by the fluid flow to make a scraping movement cleaning the annular gap.

* * * * *

UNITED STATES PATENT AND TRADEMARK OFFICE

CERTIFICATE OF CORRECTION

PATENT NO. : 5,432,310

DATED : July 11, 1995

INVENTOR(S) : Helmut Stoeger

It is certified that error appears in the above-indentified patent and that said Letters Patent is hereby corrected as shown below:

Column 4, line 16: "(second)" should read --second--

Column 4, line 23: "FIG. 9" should read --FIG. 2--

Column 7, line 56: "enable" should read --enables--

Column 9, line 30: after "between" insert -- disc 69 of--

Column 9, line 31: delete "disc 69 of"

Column 11, line 47: after "spindle" insert --in--

Signed and Sealed this

Sixth Day of August, 1996

Bruce Lehman

BRUCE LEHMAN

*Commissioner of Patents and Trademarks*

*Attest:*

*Attesting Officer*